US006463841B2

(12) United States Patent
Niwa et al.

(10) Patent No.: US 6,463,841 B2
(45) Date of Patent: Oct. 15, 2002

(54) LIFT CYLINDER

(75) Inventors: Susumu Niwa, Kani; Kouiti Kanematsu, Minokamo, both of (JP)

(73) Assignee: Kayaba Kogyo Kabushiki Kaisha (JP)

( * ) Notice: Subject to any disclaimer, the term of this patent is extended or adjusted under 35 U.S.C. 154(b) by 0 days.

(21) Appl. No.: 09/898,175

(22) Filed: Jul. 3, 2001

(65) Prior Publication Data

US 2002/0040637 A1 Apr. 11, 2002

(30) Foreign Application Priority Data

Oct. 10, 2000 (JP) ..... 2000-308555

(51) Int. Cl.[7] ..... F15B 15/22; F15B 11/08
(52) U.S. Cl. ..... 91/408; 91/422
(58) Field of Search ..... 91/408, 409, 422

(56) References Cited

U.S. PATENT DOCUMENTS 2,066,109 A * 12/1936 Hirvonen ..... 91/422 X
2,839,032 A * 6/1958 Reynolds ..... 91/422 X
3,259,026 A * 7/1966 Madland et al. ..... 91/422 X
3,656,411 A * 4/1972 Plester et al. ..... 91/422 X
3,808,946 A * 5/1974 Bell et al. ..... 91/422 X
5,193,433 A * 3/1993 Reimer ..... 91/409 X
5,307,729 A * 5/1994 Hedlund ..... 91/409 X

FOREIGN PATENT DOCUMENTS

DE 1048852 * 1/1959 ..... 91/422
GB 1245406 * 9/1971 ..... 91/422

* cited by examiner

*Primary Examiner*—John E. Ryznic
(74) *Attorney, Agent, or Firm*—McGlew and Tuttle,P.C.

(57) ABSTRACT

To facilitate assembling work of a check valve to improve workability at the time of assembling a lift cylinder.

In a lift cylinder, a check valve 4 disposed in a shaft center part of a piston 2 has a valve seat member 41, a poppet valve, a bias spring 43 and a spring receiver 44, whereas a cushion ring 21 movably held on the piston 2 is placed in contact with an open end of the valve seat member 41 to thereby prevent it from slipping out of a predetermined position.

3 Claims, 3 Drawing Sheets

LIFT CYLINDER

BACKGROUND OF THE INVENTION

The present invention relates to a lift cylinder, and particularly to an improvement in a lift cylinder which is a single action hydraulic cylinder used for a fork lift.

For example, as a lift cylinder used for a fork lift, the present inventor has developed a single action hydraulic cylinder, for example, as shown in FIG. 3. In this proposal, when pressure oil from an external hydraulic source P not shown in the figure but indicated merely by a symbol is supplied to a pressure chamber R which is a piston side chamber defined within a cylinder body 1 by a piston 2 slidably provided in the cylinder body 1, the pressure chamber R is enlarged for extending operation.

The above lift cylinder is operated to be contracted when a rod body 3 having a proximal end connected to the piston 2 is moved into the cylinder body 1 by the own weight in the rod body 3, or the rod body 3 is moved into the cylinder body 1 by a load acting on the rod body 3, whereby oil in the pressure chamber R is discharged to the hydraulic source P so that the pressure chamber R is contracted.

On the other hand, in the above lift cylinder, a non-piston side chamber defined by the piston 2 in the cylinder body 1 is made to be an air chamber A serving as a closed space as shown, and therefore, at the time of extending operation in which the rod body 3 is slipped out of the cylinder body 1, the air chamber A is compressed to exhibit a spring force. That is, this provides a function that at the time of contraction operation in which the rod body 3 is moved into the cylinder body 1, the contraction operation is assisted.

When oil leaked out of a seal S to the pressure chamber R is gradually stayed in the air chamber A, the volume of the air chamber A is reduced, and accordingly, in a case where the air spring force caused by the air chamber A in the lift cylinder becomes excessively high, oil moved into the air chamber A due to the opening operation of a check valve 4 held by the piston 2 is returned to the pressure chamber R to maintain the air spring force caused by the air chamber A in a set value.

Therefore, in this lift cylinder, the provision of the check valve 4 causes the air spring force caused by the air chamber A not to be excessively high, and accordingly, for example, a seal member not shown disposed at an open end of the cylinder body 1 to prevent leakage in the rod body 3 is prevented from being broken, thus improving durability in the lift cylinder.

However, in the above-described lift cylinder, there is the possibility to be pointed out to involve an inconvenience that when the lift cylinder is assembled, many work steps are necessary to fail to expect an improvement in workability at the time of assembly.

That is, in the lift cylinder shown in FIG. 3, the check valve 4 is disposed internally of a fitting part 2*a* formed to be tubular in the piston 2, but its constituent parts include a valve seat member 41, a poppet valve 42, a bias spring 43, a spring receiver 44 and a washer 45, and in a state that the valve seat member 41 is stopped at an upper end level-difference part 2*b* of the fitting part 2*a*, a snap ring 5 is fitted in inside at the lower end of the fitting part 2*a* to thereby prevent slipping out from the inside of the fitting part 2*a* which is a predetermined position.

Therefore, it is of course that the check valve 4 is disposed before the piston 2 is connected to the rod body 3, and the position of arrangement thereof is at a deep location, and therefore, the above-described parts, that is, many parts are to be arranged using a jig and through a communication hole 2*c* bored in a shaft center of the piston 2.

As a result, in the above-described lift cylinder, the assembling work of the check valve 4 is not easy, and accordingly, many work steps for the assembly of the check valve 4 are necessary, failing to expect an improvement in workability at the time of assembling the lift cylinder.

SUMMARY OF THE INVENTION

The present invention has been accomplished in view of the foregoing, and has its object to provide a lift cylinder which facilitates assembling work of a check valve and which will be optimum for expecting an improvement in workability at the time of assembly.

For achieving the aforementioned object, the present invention provides a lift cylinder wherein a rod body is slidably received in a cylinder body through a piston, the piston defining a pressure chamber and an air chamber within the cylinder body, the piston being provided internally with a check valve for allowing only a flow of oil from the air chamber to the pressure chamber and a cushion ring for effecting a cushion near the maximum contraction, and when the rod body is operated to be expanded and contracted at the time of supply and discharge of pressure oil to the pressure chamber and the air spring force of the air chamber becomes excessively high due to accumulation of oil which leaks out of a seal in the outer periphery of a piston from the pressure chamber and flows into the air chamber, oil is returned to the pressure chamber through the check valve, characterized in that the check valve comprises a tubular valve seat member inserted in a shaft center part of the piston, a poppet valve received in the valve seat member and seated or unseated on the inner peripheral seat surface of the valve seat member, a spring receiver secured to an open end of the valve seat member, and a bias spring carried on the spring receiver to bias the poppet valve in a direction of closing it, and the cushion ring is arranged opposedly in proximity of the valve seat member.

In this case, alternatively, the piston has a body in sliding contact with the cylinder body, and a tubular fitting part erected from the body and inserted into the piston rod, the check valve is arranged over the shaft center part of the body and the fitting part, and the cushion ring is arranged on the shaft center part of the body movably while opposing to the check valve.

Likewise, the piston has a body in sliding contact with the cylinder body, and a tubular fitting part erected from the body and inserted into the piston rod, the check valve is arranged on the shaft center part of the body, and the cushion ring is arranged on the shaft center part of the body movably while opposing to the check valve.

DETAILED DESCRIPTION OF THE PREFERRED EMBODIMENTS

Figure 1:
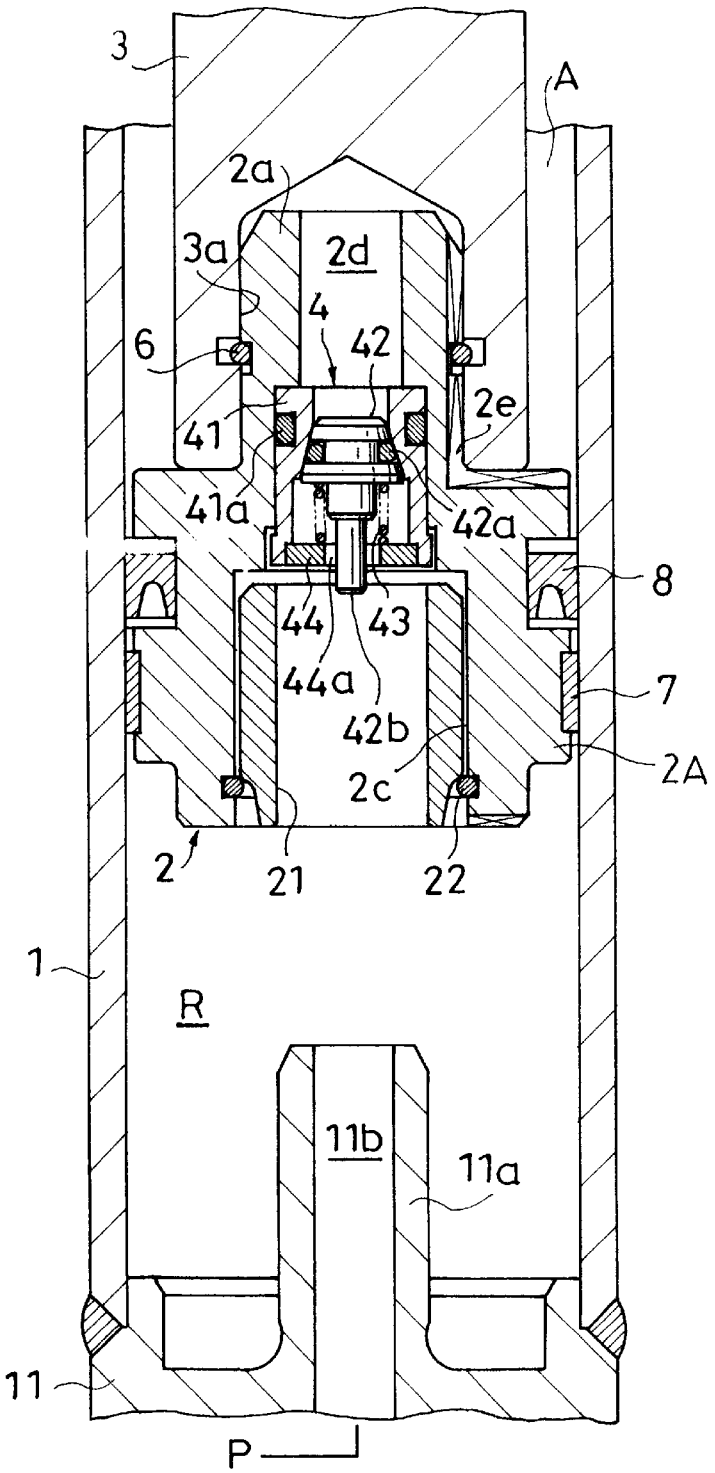
FIG. 1 is a longitudinal sectional view partly showing a lift cylinder according to one embodiment of the present invention.

In the following, the present invention will be described on the basis of the embodiment shown in the drawings.

Figure 2:
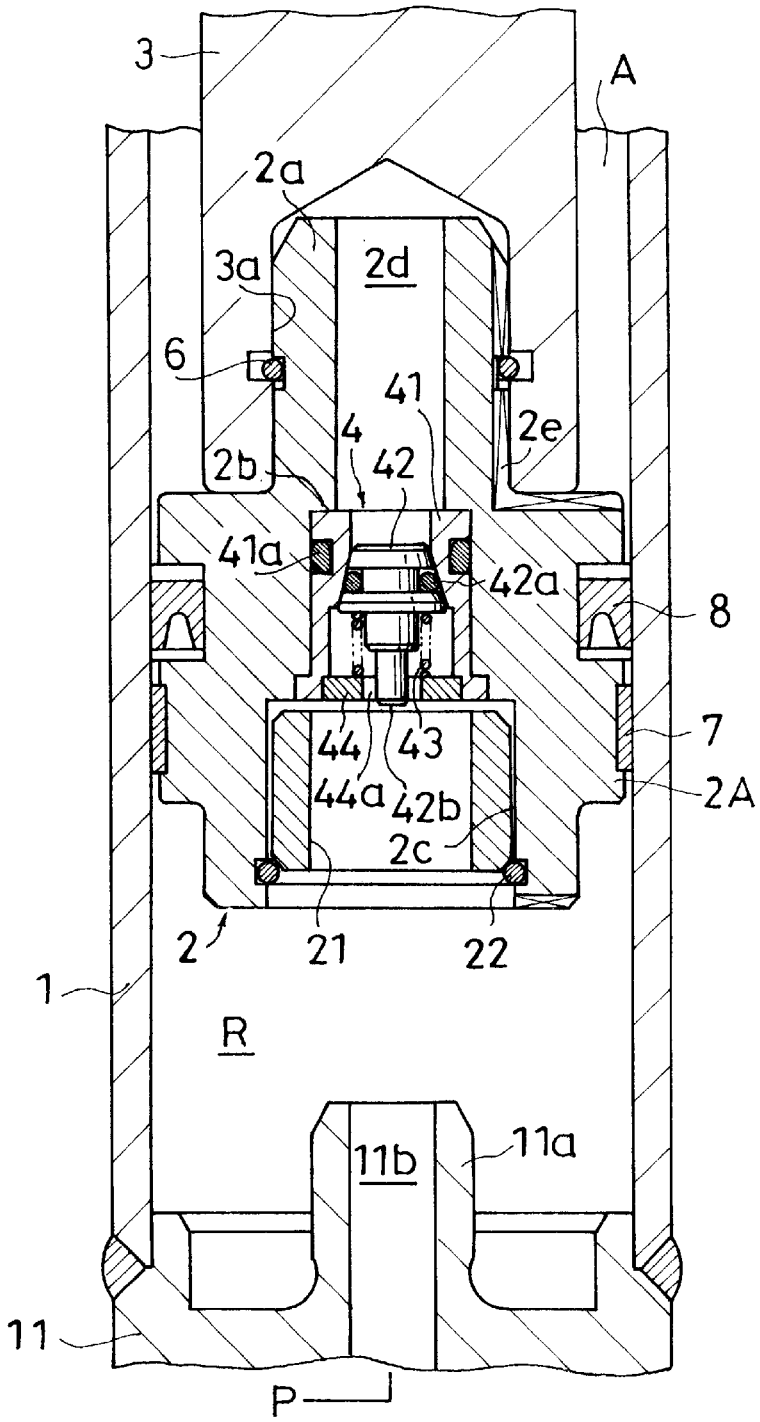
FIG. 2 is a view partly showing a lift cylinder according to a further embodiment, similarly to FIG. 1.
Figure 3:
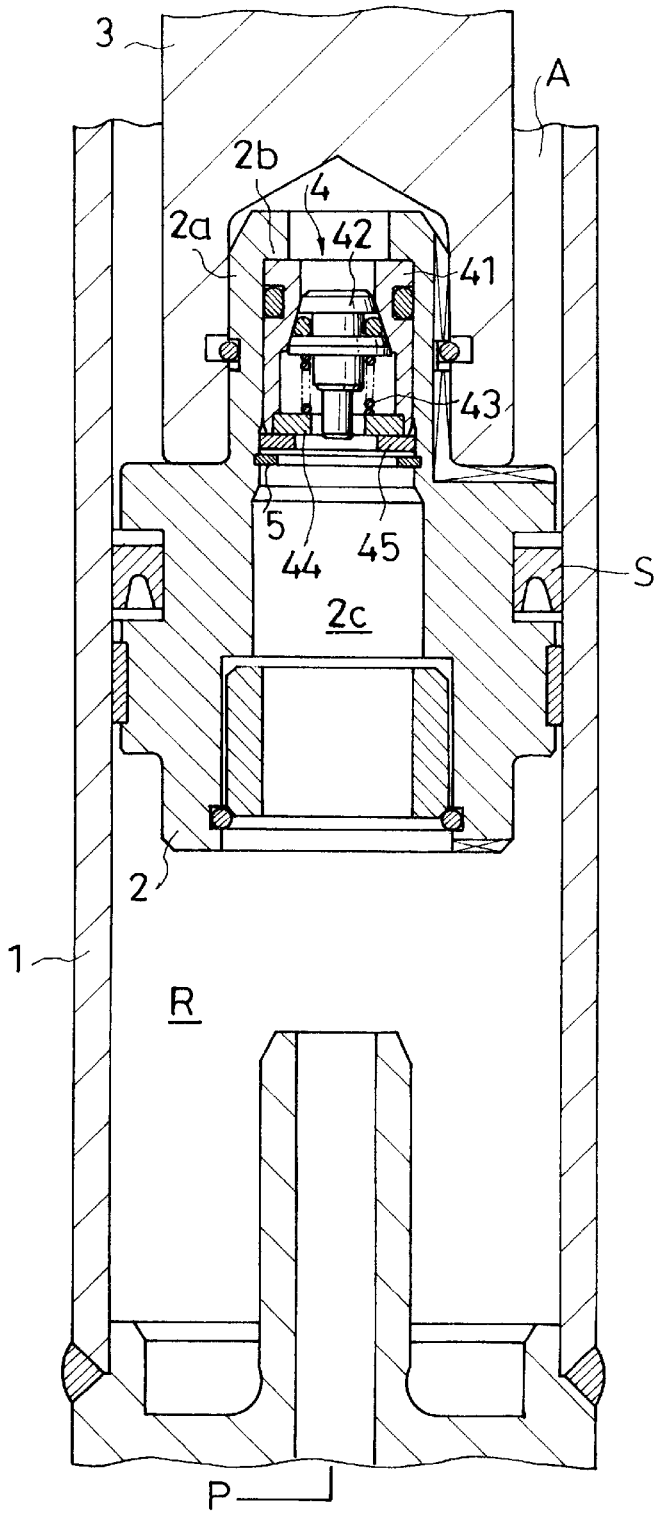
FIG. 3 is a view partly showing a lift cylinder developed by the present inventor, similarly to FIG. 1.

However, even the lift cylinder according to the present invention is basically constituted similarly to the above-described lift cylinder shown in FIG. 3, as shown in FIGS. 1 and 2.

Therefore, the constitution of the lift cylinder of the present invention similar to that of the lift cylinder shown in FIG. 3 are merely indicated by the same reference numerals in the drawings, and detailed description except necessary parts will be omitted. In the following, characteristics of the present invention will be mainly explained.

As shown in FIGS. 1 and 2, even the lift cylinder in the present invention, a cylinder body 1 has a cushion guide part 11*a* what can be fitted into a tubular cushion ring 21 provided in a shaft center part of a bottom member 11 constituting a bottom part of the cylinder body 1, an end of which is held on a piston 2 while placing the whole part in the shaft center part of a pressure chamber R.

The shaft center part of the cushion guide part 11*a* is bored with an oil passage 11*b*. Pressure oil from an external hydraulic source P is supplied to the pressure chamber R through the oil passage 11*b* or oil from the pressure chamber R is returned to the hydraulic source P whereby the lift cylinder is operated to be expanded and contracted.

Therefore, in this lift cylinder, the cushion guide part 11*a* is to be fitted internally of the cushion ring 21 near the maximum contraction when the contraction operation is just about finished, and accordingly, oil of the pressure chamber R flows out toward the external hydraulic source P through a clearance between the inner periphery of the cushion ring 21 and the outer periphery of the cushion guide part 11*a* and the oil passage 11*b*. The cushion effect is exhibited with the flow resistance when oil passes through the clearance. When the status is switched from the maximum contraction to the extension operation, oil is supplied from the hydraulic source P to the pressure chamber R though the oil passage 11*b*, but in the state that the cushion ring 21 is fitted in the cushion guide part 11*a*, a part of oil is introduced from the outer periphery of the cushion guide part 11*a* downward of a piston body 2A through abutment of a stop ring 22 to prevent occurrence of negative pressure.

The piston 2 has the body 2A and a tubular fitting part 2*a* erected from the body 2A, the body 2A being formed with a communication hole 2*c*, the fitting part 2*a* being formed with an oil passage 2*d*. That is, the inside of the fitting part 2*a* in the piston 2 in which a check valve 4 is disposed in the shaft center part comprises the oil passage 2*d*, the oil passage 2*d* being communicated with an air chamber A through a cut groove 2*e* formed in the outer periphery of the piston 2 and communicated with the pressure chamber R through the communication hole 2*c* bored in the shaft center part of the piston 2.

The cushion ring 21 is received in the communication hole 2*c* movably in the shaft center direction of the piston 2 in the mode of almost occupying the communication hole 2*c*, and the cushion ring 21 is prevented from slipping out of the communication hole 2*c* by the stop ring 22 fitted in the peripheral wall (not shown) forming the communication hole 2*c*.

Furthermore, the fitting part 2*a* in the piston 2 is inserted under the arrangement of a stop ring 6 into an insert hole 3*a* formed so as to scoop the shaft center part of the proximal end in a rod body 3.

It is noted that in the outer periphery of the piston 2, a piston ring 7 whose outer periphery is in sliding contact with the inner periphery of the cylinder body 1, and a piston seal 8 are arranged in series.

Incidentally, the lift cylinder according to the present invention has the constitution common to that of prior art, and the check valve 4 is disposed in the shaft center part of the piston 2, as shown in FIGS. 1 and 2, whereas it has a valve seat member 41, a poppet valve 42 as a valve body, a bias spring 43 and a spring receiver 44.

Therefore, since the check valve 4 in the present invention has the valve seat member 41, the poppet valve 42, the bias spring 43 and the spring receiver 44, the check valve 4 has the constitution similar to the check valve 4 in the lift cylinder shown in FIG. 3, whereas it omits a snap ring 5 and a washer 45 to reduce the parts number into a simple constitution as compared with the check valve 4 of FIG. 3.

Incidentally, the valve seat member 41 is formed to be tubular, and is disposed, in the FIG. 1 illustration, through a seal member 41*a* in the shaft center part from the body part 2A of the piston 2 to the fitting part 2*a*, while in the FIG. 2 illustration, it is likewise disposed through the seal member 41*a* in the shaft center part in the body part of the piston 2 with the piston 2 shortened.

The poppet valve 42 is received internally of the valve seat member 41 and formed to be seated or unseated on the taper surface-like seat surface in the inner periphery of the valve seat member 41, and in the figure, when moved back to be moved down, a clearance is formed relative to the inner periphery of the valve seat member 41 to allow passage of oil from upstream to be upward in the figure toward downstream to be downward in the figure.

In the illustration, the poppet valve 42 has a seal member 42*a* in the outer periphery thereof to secure liquid tightness with respect to the inner peripheral taper surface of the valve seat member 41. However, it is of course that if the predetermined liquid tightness can be secured, the arrangement of the seal member 42*a* may be omitted.

In the illustration, the bias spring 43 comprises a coil spring, in which an extreme end thereof is placed in contact with the back side of the poppet valve 42 to bias in the forward direction, which is a direction in which the poppet valve 42 is seated on the valve seat member 41.

It is of course that the spring force of the bias spring 43 is set on the basis of arrangement so that the check valve 4 causes the air spring force caused by the air chamber A not to make high in excess of necessity.

The spring receiver 44 is secured to an open end of the valve seat member 41 while holding the proximal end of the bias spring 43 by calking or pressing, and has a hole 44*a* in the center thereof allowing passage of oil and insertion of a center rod part 42*b* in the poppet valve 42 through the hole 44*a*.

The spring receiver 44 is secured to the open end of the valve seat member 41 as described above whereby the check valve 4 according to the present invention is formed into a cartridge.

In the check valve 4 according to the present invention constituted as described above, the upper end of the valve seat member 41 to be the upper end in the figure is stopped at a level-difference part 2*b* formed in the fitting part 2*a* in the piston 2 in the FIG. 1 illustration, and is stopped at the level-difference part 2*b* formed in the body part in the piston 2 in the FIG. 2 illustration.

The cushions rig 21 held movably on the piston 2 is placed in contact with the open end of the valve seat member 41 to be the lower end of the check valve 4 to thereby prevent the check valve 4 from slipping out of a predetermined position.

As a result, in the check valve 4 shown in FIG. 3 described above, the snap ring 5 is used through the washer 45 in order to prevent slipping out.

In the present invention, however, the washer 45 and the snap ring 5 are unnecessary, and particularly, mounting work for the snap ring 5 using a jig is not necessary. Further, the work step for arranging the check valve 4 at a predetermined position is not required.

Furthermore, with respect to the arrangement position of the check valve 4 in the present invention, a nearly lower half part is the body part 2A in the piston 2 in the FIG. 1 illustration, and the entirety is the body part 2A in the piston 2 in the FIG. 2 illustration. Therefore, as compared with the case where the entirety is in the fitting part 2*a* in the piston 2, the arrangement position is set to a shallow part, thus being advantageous in workability in assembly.

Since the check valve 4 is formed into a cartridge as described above, work of forcibly pressing the cartridge will suffice, and accordingly, with respect to the arrangement of the check valve 4 at a predetermined position, an exclusive-use special jig need not be prepared, which point is advantageous.

Further, since the arrangement position of the check valve 4 is not wholly in the fitting part 2*a* in the piston 2, that is, since the wall-thickness in the fitting part 2*a* need not be thin over the entirety, the strength of the fitting part 2*a* can be increased, thus being able to contribute to increase durability in the lift cylinder on the whole.

While in the FIG. 1 illustration, length of the cushion guide part 11*a* fitted internally of the cushion ring 21 is set to somewhat shorter than that of the cushion guide part 11*a* in the lift cylinder shown in FIG. 3, it is noted that this corresponds to the fact that length of the cushion ring 21 is set to somewhat longer than that of the cushion ring 21 in the conventional lift cylinder.

Accordingly, with respect to the expansion and contraction stroke in the lift cylinder shown in FIG. 1, it is advantageous in that by a portion of shortening the cushion guide part 11*a*, this can be larger than the case of the lift cylinder shown in FIG. 3.

On the other hand, in the FIG. 2 illustration, length of the cushion guide part 11 is considerably shortened as compared to that in the FIG. 1 illustration whereby the cushion guide part 11*a* is made to be substantially the same as the cushion ring 21 in the conventional lift cylinder whereby the expansion and contraction stroke in the lift cylinder can be made larger.

Therefore, in the case of this embodiment, at least, the conventional cushion ring 21 can be used, and therefore, it is advantageous in that extra design change about parts is not demanded.

The present invention as described above has the following effects.

(1) Since the check valve has the valve seat member, the poppet valve, the bias spring and the spring receiver, the constitution thereof is similar to that of the check valve in the lift cylinder developed previously, but as compared with this check valve, the parts number is reduced by a part that omits the snap ring and the washer, and in addition, in this check valve, the cushion ring held movably on the piston comes in contact with the lower end of the valve seat member to prevent slipping out of the predetermined position, resulting in a simple constitution as a whole. Moreover, since the mounting work of the snap ring and the washer can be omitted, the assembling work of the check valve is facilitated, because of which the work step is not required for assembly of the check valve. Besides, as compared with the case where the arrangement position of the check valve is internally of the tubular fitting part in the piston, it is a so-called shallow location, thus being advantageous in terms of workability in assembly.

(2) In the check valve, the open end of the valve seat member is subject to calking to fixedly mount the spring receiver, and the entirety is formed into a cartridge, and therefore, work for pressing in the cartridge will suffice. Accordingly, it is advantages in terms of the fact that with respect to the arrangement of the check valve at a predetermined position, an exclusive-use special jig need not be prepared. Further, since the arrangement position of the check valve is not only within the fitting part in the piston, the whole wall-thickness of the fitting part need not be made thin, the strength of the fitting part can be increased, providing an advantage capable of contributing to increase durability in the lift cylinder on the whole.

(3) As a result, according to the present invention, the assembling work of the check valve is facilitated, and it will be optimum to expect an improvement of workability at the time of assembling the lift cylinder.

What is claimed is:

1. A lift cylinder wherein a rod body is slidably received in a cylinder body through a piston, the piston defining a pressure chamber and an air chamber within the cylinder body, the piston being provided internally with a check valve for allowing only a flow of oil from the air chamber to the pressure chamber and a cushion ring for effecting a cushion near the maximum contraction, and when the rod body is operated to be expanded and contracted at the time of supply and discharge of pressure oil to the pressure chamber and the air spring force of the air chamber becomes excessively high due to accumulation of oil which leaks out of a seal in the outer periphery of a piston from the pressure chamber and flows into the air chamber, oil is returned to the pressure chamber through the check valve, characterized in that the check valve comprises a tubular valve seat member inserted in a shaft center part of the piston, a poppet valve received in the valve seat member and seated or unseated on the inner peripheral seat surface of the valve seat member, a spring receiver secured to an open end of the valve seat member, and a bias spring carried on the spring receiver to bias the poppet valve in a direction of closing it, and the cushion ring is arranged opposedly in proximity of the valve seat member.

2. A lift cylinder according to claim 1 wherein the piston has a body in sliding contact with the cylinder body, and a tubular fitting part erected from the body and inserted into the piston rod, the check valve is arranged over the shaft center part of the body and the fitting part, and the cushion ring is arranged on the shaft center part of the body movably while opposing to the check valve.

3. A lift cylinder according to claim 1 wherein the piston has a body in sliding contact with the cylinder body, and a tubular fitting part erected from the body and inserted into the piston rod, the check valve is arranged on the shaft center part of the body, and the cushion ring is arranged on the shaft center part of the body movably while opposing to the check valve.

* * * * *